US005901235A

United States Patent [19]

Thigpen et al.

[11] Patent Number: 5,901,235

[45] Date of Patent: May 4, 1999

[54] ENHANCED EFFICIENCY PLANAR TRANSDUCERS

[75] Inventors: F. Bruce Thigpen, Tallahassee; Claude Jeff Raley, Sneads, both of Fla.

[73] Assignee: Eminent Technology, Inc., Tallahassee, Fla.

[21] Appl. No.: 08/936,120

[22] Filed: Sep. 24, 1997

[51] Int. Cl.[6] ..... H04R 25/00

[52] U.S. Cl. ..... 381/431; 381/408; 381/399

[58] Field of Search ..... 381/399, 408, 381/421, 423, 431, FOR 156, FOR 163

[56] References Cited

U.S. PATENT DOCUMENTS 3,873,784 3/1975 Doschek .

FOREIGN PATENT DOCUMENTS 0020013 2/1977 Japan .

0037419 3/1977 Japan .

0038915 3/1977 Japan .

2043003 of 0000 Russian Federation .

*Primary Examiner*—Huyen Le

*Attorney, Agent, or Firm*—Dowell & Dowell, P.C.

[57] ABSTRACT

Planar magnetic transducers including diaphragms having electrical conductors thereon which are mounted within frames so that spaced magnets are disposed on opposite sides of central sound producing surface areas of the diaphragms. Pole elements are provided in spaced relationship between each of the magnets and extend inwardly toward the diaphragms so to form pole extensions for causing magnetic flux from the poles of the magnets proximate to the diaphragms to extend more densely and generally parallel to the electrical conductors between the magnets and the pole elements. Openings for acoustic waves are provided between the pole elements and adjacent magnets.

20 Claims, 3 Drawing Sheets

20A
20B
21A
21C
22A
24
28
32
40A
40B
40C
42A
42A'
42B
42C
42C'
50
51
52
53
54
60
62

ENHANCED EFFICIENCY PLANAR TRANSDUCERS

BACKGROUND OF THE INVENTION

1. Field of the Invention

This invention is generally directed to transducers which incorporate a vibrating diaphragm, and more specifically to planar magnetic transducers which include magnets mounted on opposite sides of a diaphragm on which an electrical conductor circuit has been applied. The invention is directed to pole elements spaced intermediate each of the magnets on opposite sides of the sound producing diaphragm which function to enhance transducer efficiency by reducing magnetic flux leakage and causing the magnetic flux field from the pole faces of the magnets adjacent the diaphragm to assume a more parallel orientation relative to the conductor circuit of the diaphragm between the magnets and the pole elements.

2. History of the Related Art

In microphone transducers, acoustic pressure variations act on a diaphragm surface causing the diaphragm to vibrate. The resultant vibrations of conductors associated with the diaphragm, while retained within a magnetic field of the transducer, create a voltage signal of similar time variance and intensity characteristics as the acoustic signal used to supply the conductors of the diaphragm. In a loudspeaker transducer, an audio signal current flows through conductors of a diaphragm. A magnetic field is created by current flowing the conductors which reacts with the magnetic field of magnets mounted in proximity to the diaphragm, thereby causing magnetic forces to act on the conductors that create sound pressure waves along the diaphragm surface which are proportional and synchronous to audio signals applied to the conductors.

Diaphragms of planar magnetic loudspeakers are normally held loose or under tension in a plane parallel to the pole faces of one or more permanent magnets so as to be in the space of the static magnetic field of the magnets. An active surface area of the diaphragm, which is an area of the diaphragm which is not constrained from motion by a rigid supporting frame to which the diaphragm is attached, is vibrated when electrical signals are provided to conductor circuits attached to the diaphragm. Conductors are attached to the diaphragm in runs which, in many transducers, are generally parallel with the edges or pole faces of the permanent magnets. The path of the conductors on the diaphragm is chosen so that current flowing therethrough produces net magnetic forces of uniform direction for all of the conductor segments or runs along the active surface of the diaphragm by causing the general direction of diaphragm motion to always be perpendicular to the diaphragm surface.

The diaphragm active surface area is chosen for particular acoustic response characteristics, such as frequency response or dispersion. The spacing of conductors and the adjacent magnetics are chosen so that the diaphragm is uniformly driven across its entire active surface area for low distortion or maximum band width. As an alternative, the conductor spacing may be chosen for optimum efficiency for a particular frequency band width or for various other reasons. The electrical circuit formed by conductor runs or segments on the diaphragm is designed concurrent with the arrangement of permanent magnets so that sufficient magnetic field strength and proper magnetic field orientation is provided to all active conductor segments or runs to achieve adequate transducer efficiency.

Conductor runs on the diaphragm may take a variety of configurations, including round or rectangular. The conductors may be bonded to a diaphragm or foil conductor patterns chemically etched from foil laminates. The conductor dimensions, compositions and circuit arrangements are often chosen to meet a desired circuit impedance requirement for maximum efficiency within practical limitations. At the present time, aluminum or aluminum-clad conductors are preferably utilized for conductors due to lower mass and lower overall mass-resistivity produced over other conductor metals. Lower mass has an inherent advantage for fast transient response and lower mass-resistivity equates to higher efficiency.

The magnet materials are chosen for cost, ease of fabrication and magnetic parameters. Optimal magnet spacing, geometry and dimensional criteria may vary the magnetic material utilized in a particular application. An "air gap dimension", the spacing between a diaphragm of magnetic transducers and the magnets thereof, should be minimized for maximum efficiency but must be chosen to allow for adequate diaphragm motion at low frequencies. The optimum spacing between adjacent magnets of each assembly is also influenced directly by the air gap length.

The advantages of planar magnetic loudspeakers over other electromagnetic arrangements is that planar magnetic loudspeakers have lower distortion and more accurate phase response when compared to cone radiator type loudspeakers. U.S. Pat. No. 3,939,312 to McKay discloses a push-pull type planar magnetic transducer arrangement wherein magnets are positioned to direct a magnetic flux across the diaphragm in a slant angle with conductor runs applied to the diaphragm. In U.S. Pat. No. 4,471,173 to Winey, another push-pull magnetic arrangement is shown wherein magnets are positioned in alternating sets of rows so that magnetic fluxes are supposed to be directed tangential to the diaphragm from the north pole face of one magnet to the south pole face of an adjacent magnet and so forth across the width of the transducer with the magnets in opposing assemblies of magnets on opposite sides of a diaphragm providing repellant magnetic forces to bound the path of the magnetic flux field.

In U.S. Pat. No. 4,337,379 to Nakaya, arrays of square magnets alternating in polarity is disclosed which are retained in two similar assemblies of equivalent magnetic pole structures with a diaphragm contoured with conductor patterns arranged to minimize resonance mode inherent in some planar transducer designs.

Each of these magnetic transducer designs and other prior art structures create a long, and therefore low, permanence path for the magnetic flux from the pole faces of the magnets proximate to the conductors carried by the sound producing diaphragms. Gauss' law dictates that the flux of each permanent magnet must form a closed loop through both poles of each magnet and take the highest permanence path from pole face to pole face. Therefore, the longer the flux path, the less efficient the transducer.

SUMMARY OF THE INVENTION

This invention is directed to planar magnetic transducers having higher operating efficiencies and, more specifically, planar magnetic transducers of the type which may be utilized as speakers for generation of sound where the transducers include housings having a flexible sound generating diaphragm mounted therein on which electrical conductor runs are applied for receiving electrical signals from an outside source. The housing includes opposing frame sections, each having an inner surface which supports a plurality of magnets which are secured thereto in spaced relationship with respect to one another. Spaced between the magnets, and from each of the magnets, are a plurality of pole elements which extend from the frame sections inwardly toward the diaphragm within the housing. In the preferred embodiment, the pole elements are co-planar with respect to pole faces of the magnets which are spaced closely to the diaphragm. In the preferred embodiment, openings or slots are provided between each pole element and an adjacent magnet for purposes of allowing sound waves to pass therethrough. Also, in the preferred embodiment, each of the magnets has the same pole facing the diaphragm and the pole faces on opposite sides of the diaphragm are aligned with one another.

In one embodiment of the invention, the magnets are permanent magnets having a cross-section which is substantially equal to the cross-section of the adjacent pole elements.

In another embodiment, the pole elements are formed as end flanges of separate sections of each of the opposing frame sections with flanges of each section being welded or otherwise secured to one another to form combined pole elements. In yet another embodiment, each of the frame sections is rolled from a rear surface, thereby forming pole elements having spaced wall segments and a curved end wall spaced adjacent to the diaphragm. In yet another embodiment, the frame sections are stamped from a rear surface in order to form generally U-shaped pole elements having generally planar end surface portions spaced adjacent to the surface of the diaphragm.

In another embodiment of the present invention, the frame sections may also be stamped from the rear surface to create indented support portions on which the magnets may be seated so as to be spaced more closely to the diaphragm with adjacent openings being provided through the housing frame sections so as to be spaced generally rearwardly of the magnets.

It is the primary purpose of the present invention to achieve greater efficiency in planar magnetic transducers by providing pole elements intermediate magnets associated with the transducer wherein the pole elements are spaced at a distance from adjacent magnets to cause the magnetic flux to flow from magnetic pole faces adjacent the diaphragm, generally parallel to the diaphragm and to the adjacent pole elements so as to thereby reduce magnetic losses or leakage and make more efficient use of the magnetic field of the magnets relative to the conductor runs across the diaphragm.

It is also an object of the present invention to increase the efficiency of planar magnetic transducers by up to 30% by reducing magnetic leakage by positively directing the flux field from the magnets to adjacent pole elements while simultaneously containing the flux field by orienting similar poles of the magnets in opposing relationship on opposite sides of the diaphragm.

It is a further object of the present invention to reduce stray magnetic leakage external of the housing of a planar magnetic transducer.

DESCRIPTION OF THE PREFERRED EMBODIMENT

The present invention is directed to planar magnetic transducers having greater operating efficiency than conventional transducers of a similar type. The invention will be discussed with respect to several different embodiments which exemplify the novel aspects thereof.

Figure 1:
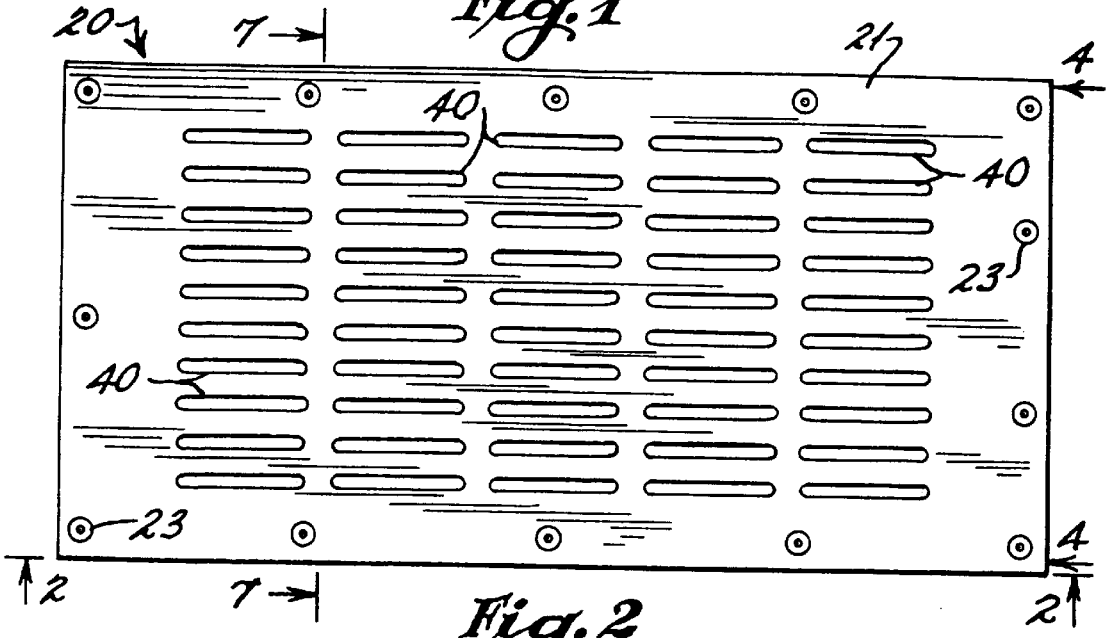
FIG. 1 is a top plan view of a planar magnetic transducer constructed in accordance with the teachings of one embodiment of the present invention shown as assembled.
Figure 2:
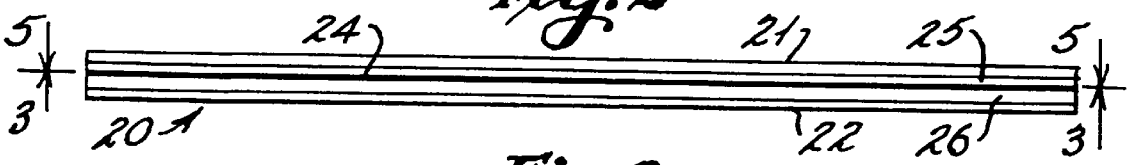
FIG. 2 is a side elevational view taken along line 2—2 of the transducer shown in FIG. 1.
Figure 3:
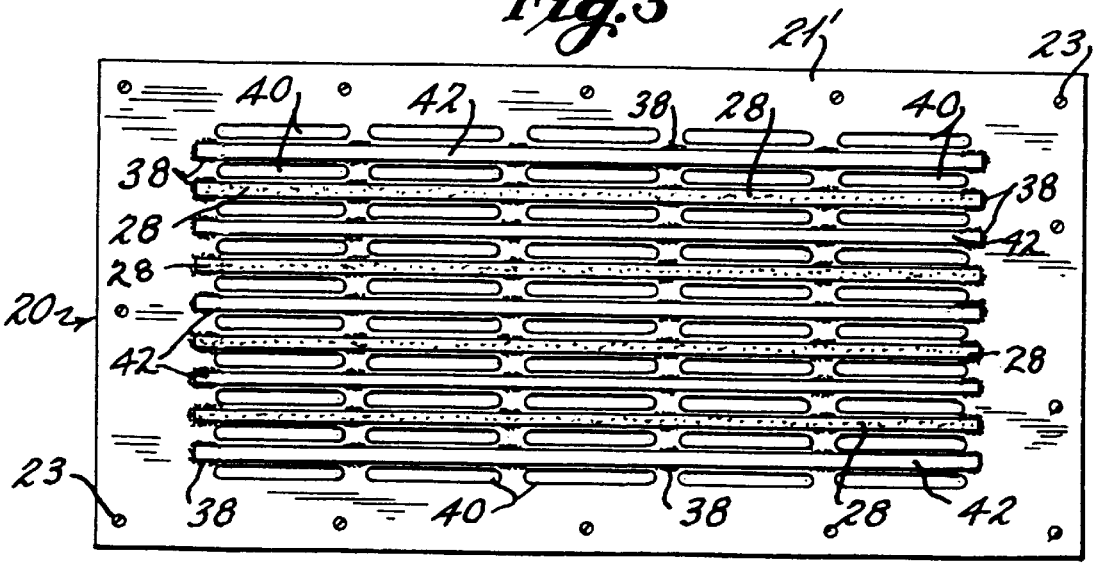
FIG. 3 is a cross-sectional view taken along line 3—3 of FIG. 2 showing the placement of elongated permanent magnets and interspaced pole elements within the upper frame section of the transducer of FIG. 1.
Figure 4:
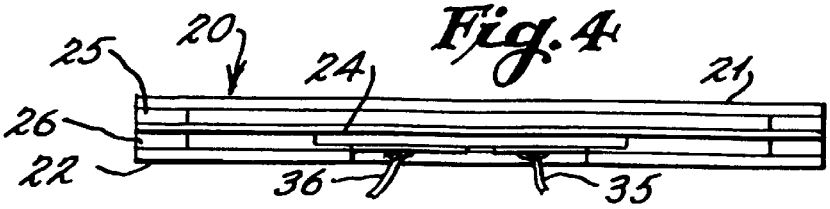
FIG. 4 is an end view taken along line 4—4 of FIG. 1.

With particular respect to FIGS. 1–7, a first embodiment of the present invention is disclosed. The transducer includes a housing 20 including opposed frame sections 21 and 22 which are preferably formed of a mild magnetic steel material and which are joined around their peripheral portions by suitable fasteners, such as screws or rivets 23. As shown in FIGS. 2 and 4, a flexible resonant diaphragm 24, which may be formed of a polyester film such as Mylar™ and which is approximately 1 mil or less in thickness, is clampingly mounted between the transducer sections 21 and 22 in such a manner that proper tension is maintained uniformly across the surface of the diaphragm. The diaphragm is supported between the transducer sections 21 and 22 by insulating spacers 25 and 26 which are of a size to crate an effective air gap dimension between the diaphragm and permanent magnets 28 mounted within the transducer housing in a manner as will be described in greater detail hereinafter. The portion of the diaphragm spaced inwardly of the frame sections 21 and 22 and spacer elements 25 and 26 is referred to as the "active" or "sound producing area" of the diaphragm and is clearly shown in FIG. 7. This is the portion of the diaphragm that vibrates when the transducer is in use.

Figure 5:
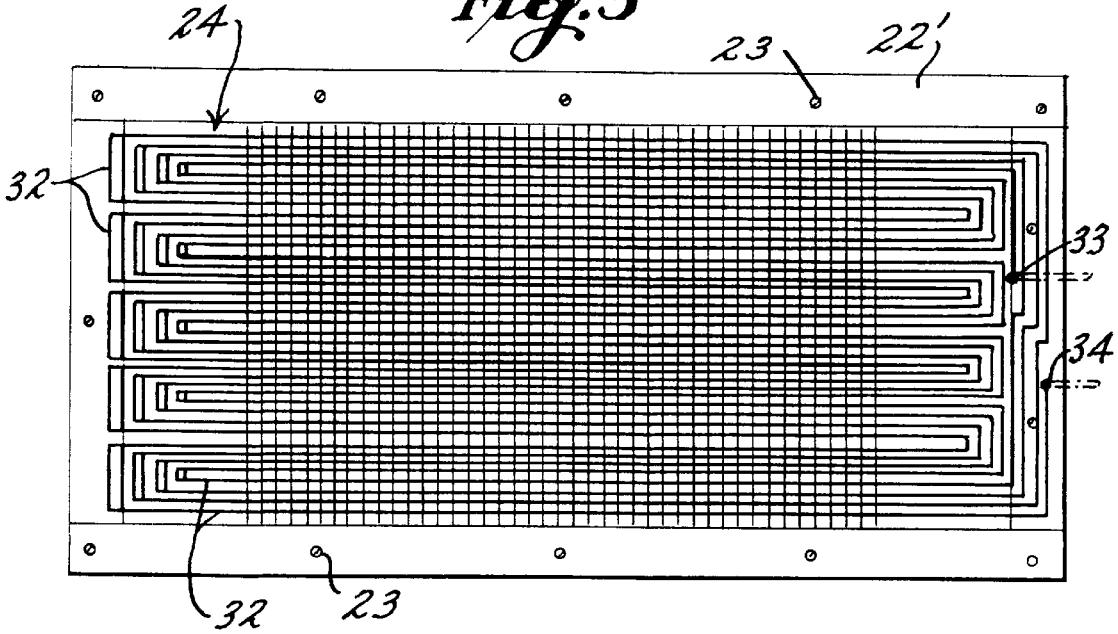
FIG. 5 is a cross-sectional view taken along line 5—5 of FIG. 2 showing an internal diaphragm having a conductor circuit applied thereto in accordance with the teachings of the present invention.
Figure 6:
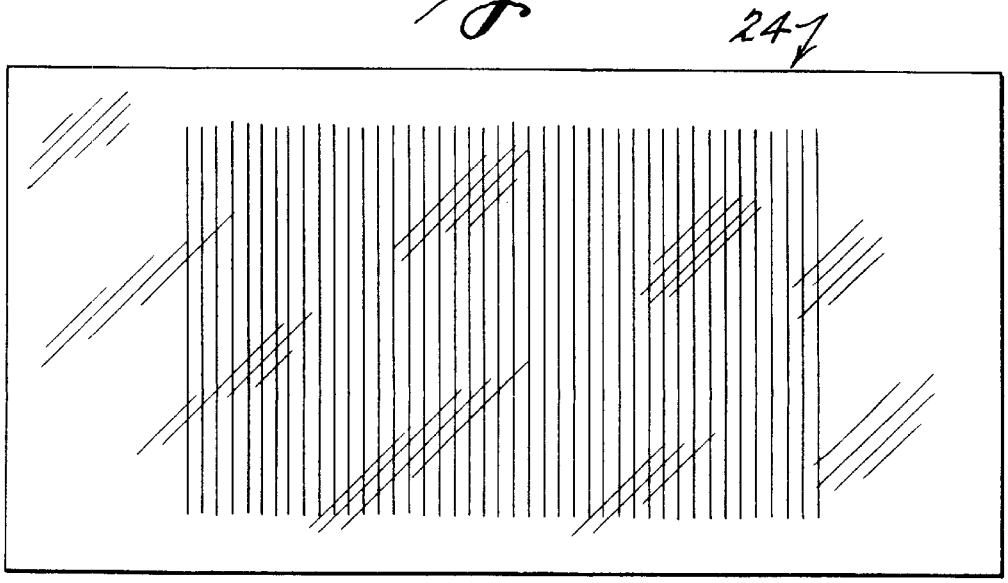
FIG. 6 is a bottom plan view of the diaphragm shown in FIG. 5.

The transducer shown in FIGS. 1–7 is described as a double-ended or push-pull transducer wherein the magnets 28 are provided on opposite sides of the diaphragm 24. Electrical conductor runs 32 are provided on a surface of the diaphragm 24 and include positive and negative ends 33 and 34 which, when the transducer sections are assembled, are in electrical contact with positive and negative terminals 35 and 36 of the transducer. The terminals are connected to an appropriate source of electrical current such as an amplifier (not shown). The conductor runs are preferably formed of aluminum and may be attached by a number of practical means. The preferred method of applying the conductor runs to the diaphragm consists of printing a conductor pattern useful to the permanent magnet layout incorporated with the transducer with etch resistant ink on aluminum foil applied to one side of the diaphragm material. The diaphragm or polyester-foil laminate may then be chemically etched to remove aluminum not covered by the printed conductor pattern. Although the conductor runs shown in FIG. 5 are generally parallel with respect to one another, other conductor configurations may be utilized depending upon the use and physical layout of the permanent magnets associated with a particular transducer. Utilizing the configuration of conductor runs of the present invention and the magnets 28 disposed on opposite sides of the diaphragm, the conductor runs on the diaphragm will be uniformly driven for any position within the active area of the diaphragm between the opposing magnets 28.

In the preferred embodiment disclosed, like pole faces, north poles being shown in the drawing figures, are oriented in opposing relationship on opposite sides of the diaphragm. The opposing pole faces create forces of repulsion between the magnetic assembly defined by the plurality of magnets 28 secured to the upper frame section 21 and the magnetic assembly defined by the plurality of spaced elongated magnets 28 mounted to the lower frame section 22. It should, however, be noted that as opposed to having each of the magnets 28 having like poles, north poles as shown in the drawings, adjacent the diaphragm, in some embodiments, the magnets on the same side of the diaphragm may have different poles facing or adjacent to the diaphragm. That is, one magnet may have its north pole facing the diaphragm with an adjacent magnet or magnets on both sides thereof having their south poles facing the diaphragm. Regardless of the pole orientation of the magnets along one side of the diaphragm, the opposing poles of the magnets on the opposite side of the diaphragm should be the same such that north poles align with north poles and south poles align with south poles.

Figure 7:
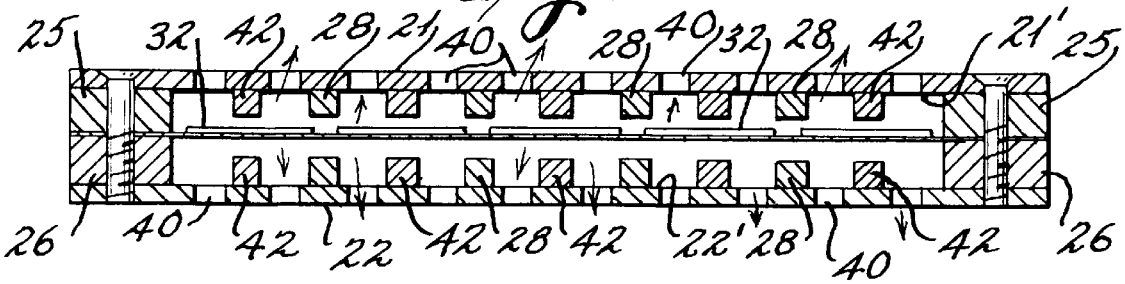
FIG. 7 is an enlarged cross-sectional illustrational view taken along line 7—7 of FIG. 1.

With particular reference to FIGS. 3 and 7, in view of the orientation of the magnets, the magnetic field created by each magnet is repulsed by the magnetic field of the magnet in opposition thereto. Further, in the preferred embodiment, the magnetic fields are also repulsed by the magnetic fields of magnets adjacent to one another in the same or same side of the diaphragm assembly. The magnets are preferably permanent magnets formed as elongated strips of rectangular cross-section which are easily cut, sliced or molded from larger blocks to any suitable dimension. The preferred composition of the magnetic material is known as Ceramic 5 or 8 or Neodimium. However, any other type of permanent magnetic material or electromagnetic material can be used in the arrangements unique to the present invention.

It is preferred that the magnets are pre-magnetized and then secured in parallel rows to the inner surfaces of the frame sections 21 and 22 with a dampening adhesive such as a silicone caulk, such as shown at 38 in FIG. 4. The magnets are spaced to allow passage of the magnetic flux induced by the magnets and also to allow passage of acoustic waves generated by the diaphragm. In order to allow passage of acoustic waves from the frame sections 21 and 22, a series of open slots 40 are provided in spaced and generally parallel relationship on opposite sides of each of the magnets 28. As opposed to a plurality of spaced slots, perforations or continuously open channels may be utilized to allow acoustic waves to pass from the diaphragm exteriorly of the transducer.

To provide greater transducer efficiency and reduce magnetic leakage for a given volume of magnets and with a specific diaphragm/conductor configuration, the present invention incorporates a plurality of protruding magnetic pole structures 42 which are either integrally formed or adhesively secured to the inner surfaces of each of the transducer sections 21 and 22 intermediate each of the magnets 28. The pole structures are spaced intermediate the openings or slots 40. Each magnetic pole structure or element 42 has a higher magnetic permanence than air. The pole elements are designed to provide a higher permanence path for the magnetic flux of each of the magnets 28 to thereby create greater density of the flux field adjacent the diaphragm than is otherwise achievable without the pole elements. Each pole element 42 extends toward the diaphragm so as to be spaced at approximately the same distance as the air gap dimension or space between the poles faces of the magnets and diaphragm. The pole elements are also spaced a sufficient distance from adjacent magnets to allow passage of the acoustic waves through the slots 40.

In view of the foregoing, the magnetic flux from each of the magnets will be constrained by opposing poles of the magnets and, in the preferred embodiment by the adjacent magnetic poles, and will extend generally parallel to the diaphragm or the plane of the electrical conductor runs outwardly to the adjacent pole elements. Therefore, in the present invention, the magnetic arrangement together with the intermediate pole pieces creates magnetic fields of higher flux density in directions parallel to the diaphragm surface and perpendicular to the conductor runs thereon than is possible with other prior art transducers. This leads to improved transducer efficiency for a given type or amount of magnetic material utilized within the transducer. The lines of flux are illustrated clearly in FIGS. 8 and 9 which are directed to alternate embodiments of the present invention. It should be noted, however, that the flux fields of the embodiment shown in FIG. 7 would be similar.

In the embodiment shown in FIG. 7, the cross-sectional dimension of each of the pole pieces or elements 42 is substantially the same as that of the adjacent magnets 28. In some embodiments, this dimension may vary. In operation, each of the pole pieces or elements functions to act as an extension of the opposite face of the adjacent magnets which is mounted against a back plane defined by the inner surfaces of 21' and 22' of the frame sections 21 and 22. In the example shown, the south pole faces of each of the magnets 28 is mounted to the back plane. It should be noted that the invention may be utilized with the south pole faces in opposing relationship with one another on opposite sides of the diaphragm and/or the north pole faces in opposing relationship.

Figures 8, 9, 10:
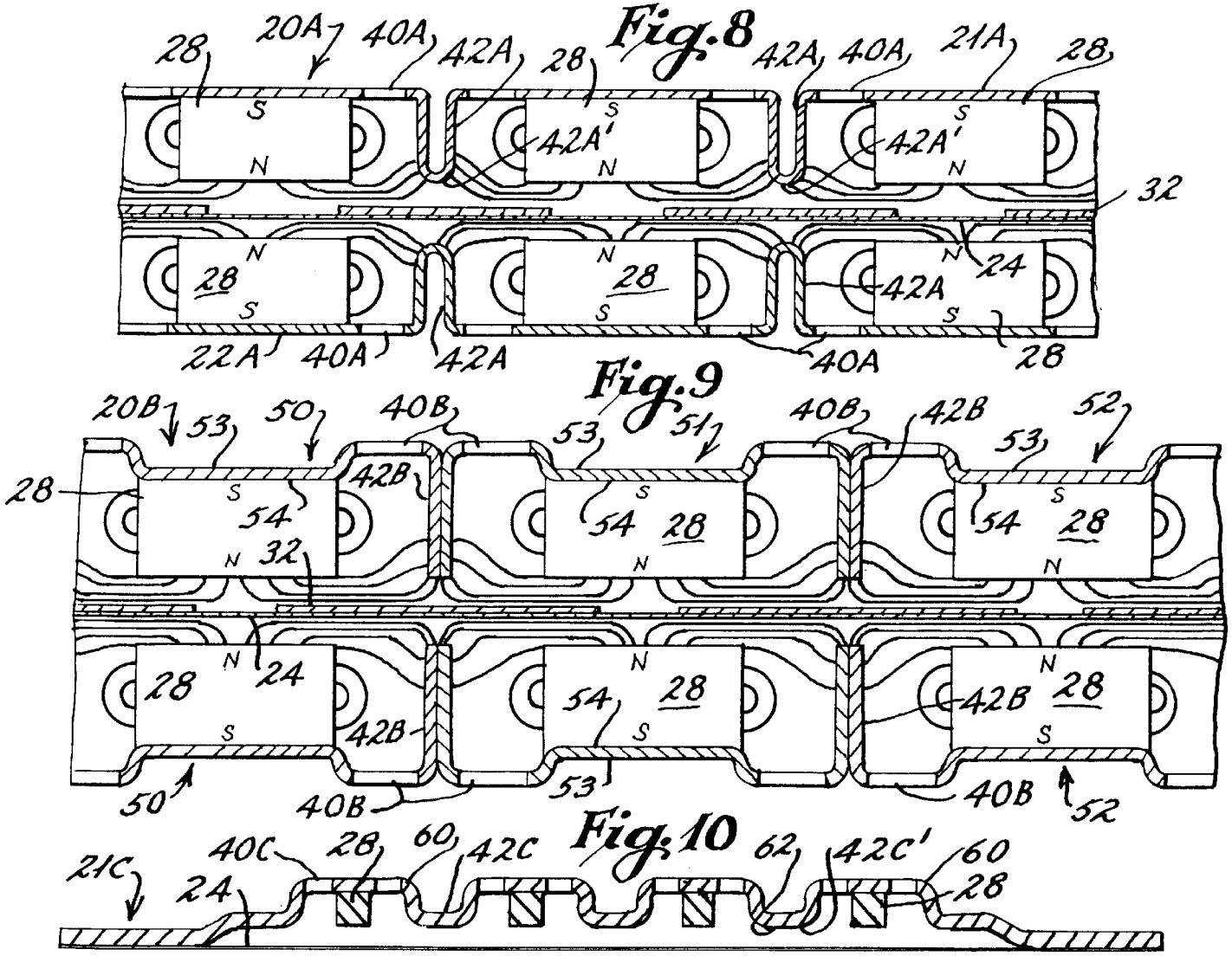
FIG. 8 is an enlarged cross-sectional view similar to FIG. 7 showing another embodiment of the present invention and illustrating the lines of magnetic flux between the magnets and adjacent pole elements of the transducer.
FIG. 9 is a view similar to FIG. 8 showing yet another embodiment of the present invention.
FIG. 10 is a partial view similar to FIGS. 8 and 9 showing only the upper frame section of the transducer having the permanent magnets mounted intermediate spaced pole elements integrally formed with the frame section in accordance with a preferred embodiment of the present invention.

With specific reference to FIG. 8, another embodiment of the invention is disclosed. In this embodiment, the characteristics of the diaphragm 24 and the conductor runs 32 applied thereto are the same as with respect to the first embodiment. In this embodiment, housing 20A is defined by opposing mildly magnetic steel material backplates or sections 21A and 22A which are each formed of a continuous or single sheet. The magnets 28 are also mounted in opposing relationship with one another with like pole faces facing one another on opposite sides of the diaphragm and electrical conductor runs. The pole elements 42A, however, are formed by rolling the sheets of metallic material of the frame sections 21A and 22A so that each pole element is in the configuration of a somewhat closed "U" including a pair of spaced wall segments which are integrally united at an innermost round end portion 42A'. Holes, slots or openings 40A are provided between each of the wall segments of the pole elements 42A and the adjacent magnets 28 for the same purposes as discussed above with respect to the previous embodiment. As shown in the drawing figures, the magnetic field created by the intermediate pole elements 42A is such to cause the magnetic lines of flux to extend generally parallel to the diaphragm and outwardly to the end portions of the pole elements which are in closer proximity than the opposite pole of the magnets. In the embodiment shown, the innermost end portion 42A' of each of the pole elements 42A is generally co-planar with the north pole faces of the magnets.

With respect to FIG. 9, a further embodiment of the invention is shown wherein the characteristics of the diaphragm 24 and electrical conductors 32 is the same as described with respect to the embodiment of FIGS. 1–7. In this embodiment, the transducer housing 20B is formed of opposing mild magnetic steel material back plate or frame sections 21B and 22B. Although each of the frame members 21B and 22B may be formed of a single sheet of material, by way of example and illustration, in FIG. 9, the cross-section shows a plurality of separate sections of steel material being joined in side-by-side relationship, such as by welding or an appropriate adhesive. Each separate section 50, 51 and 52 of each of the frame sections includes a stamped portion 53 which functions as a metallic seat which extends inwardly with respect to the outer plane defined by each of the sections 21B and 22B. Each of the stamped seats 54 serve as a support for a magnet 28. The pole elements 42B of each section 50, 51 and 52 are shown as being bent perpendicularly with respect to the plane defined by the outer surface by each of the frame sections 21B and 22B and extend inwardly and terminate generally aligned with the front face or poles of each of the magnets 28. Adjacent pole elements 42B may be welded or otherwise secured to one another.

Intermediate each of the pole elements 42B and the adjacent magnets 28 are openings or slots 40B for purposes of allowing acoustic waves to pass therethrough. With this embodiment, the magnets are positioned in closer proximity to the diaphragm to further reduce leakage or loss of magnetic flux.

With specific reference to FIG. 10, another embodiment of the invention is disclosed. In this embodiment, only the upper backplate or frame section 21C of a transducer, similar to that as previously discussed, is shown. It should be remembered that the opposing frame or backplate member would be a mirror image of the section 21C. In this embodiment, each backplate or frame member 21C is stamped from a single sheet of mildly magnetic steel material with the pole elements 42C being formed as enlarged U-shaped elements which extend inwardly relative to the outer surface 60 of the section and which terminate at a position which is generally co-extensive with the front face of each of the magnets 28. It is generally preferred that the pole elements be of a size which is substantially similar to the adjacent magnets 28 although the drawing figure shows them as being somewhat larger. Further, the end portions 42C' are generally flat. Intermediate each of the magnets and along the outer plane of section 21C are spaced openings or slots 40C for purposes of allowing acoustic waves to pass therethrough. The stamped configuration of the housing section 21C may be preferred in mass production to reduce manufacturing costs.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A planar magnetic transducer comprising:

a housing having opposing frame sections;

a flexible diaphragm mounted between said frame sections and having electrical conductor segments thereon;

a plurality of magnet means mounted within said housing and secured in spaced relationship with respect to one another to each of said frame sections, said magnet means having poles facing said diaphragm;

pole elements extending from each of said frame sections toward said diaphragm, said pole elements being spaced between and from each of said magnet means;

an opening between at least one of said magnet means and at least one of said pole elements through at least one of said frame sections to allow acoustic waves to pass therethrough whereby magnetic flux from poles of said magnet means is partially directed generally parallel to said diaphragm from said like poles of said magnet means to said pole elements.

2. The planar magnetic transducer of claim 1 wherein said poles of said magnet means are in opposing and generally aligned relationship with respect to one another on opposite sides of said diaphragm, and the opposing poles being of the same polarity.

3. The planar magnetic transducer of claim 2 wherein said poles of said magnet means are substantially co-planar with inner ends of adjacent pole elements.

4. The planar magnetic transducer of claim 2 wherein said pole elements are formed as pairs of flanges secured to one another.

5. The planar magnetic transducer of claim 4 wherein said frame sections are formed from separate segments secured to one another along said flanges forming each of said pole elements.

6. The planar magnetic transducer of claim 2 including openings between each of said magnet means and said pole elements.

7. The planar magnetic transducer of claim 6 wherein said magnet means are permanent magnets, and each of said poles of said permanent magnets having said diaphragm being of the same polarity.

8. The planar magnetic transducer of claim 2 wherein each of said opposing frame sections includes an outer surface which is stamped to provide inwardly extending portions, said magnetic means being mounted to said inwardly extending portions.

9. The planar magnetic transducer of claim 8 wherein a plurality of openings are provided through each of said opposing frame sections spaced from said stamped portions and between each of said magnet means and said pole elements.

10. The planar magnetic transducer of claim 9 wherein said pole elements are generally U-shaped in cross-section.

11. The planar magnetic transducer of claim 2 wherein said frame sections are formed of a steel material and said magnet means are permanent magnets.

12. The planar magnetic transducer of claim 2 wherein each of said poles of said magnet means facing said diaphragm having the same polarity.

13. The planar magnetic transducer of claim 2 wherein each of said frame sections includes an outer surface which is deformed to provide inwardly extending wall portions which function as said pole elements and which are integrally connected at an end extending proximate to said diaphragm.

14. The planar magnetic transducer of claim 2 wherein said pole elements have a cross-section substantially equal to a cross-section of said magnet means.

15. A planar magnetic transducer comprising:

a housing having opposing frame sections;

a flexible diaphragm mounted between said frame sections and having electrical conductor segments thereon;

a plurality of magnet means mounted within said housing and secured in spaced relationship with respect to one another to each of said frame sections, said magnet means having like poles facing said diaphragm and being aligned with one another on opposite sides of said diaphragm and opposite poles engaged to said frame sections;

pole elements extending from each of said frame sections toward said diaphragm, said pole elements being spaced between and from each of said magnet means at a distance wherein magnetic flux from said like poles will extend at least partially to said pole elements; and openings between said magnet means and said pole elements through which acoustic waves may pass whereby magnetic flux from like poles of said magnet means is partially directed generally parallel to said diaphragm toward said poles elements.

16. The planar magnetic transducer of claim 15 wherein said pole elements have a cross-section substantially equal to a cross-section of said magnet means.

17. The planar magnetic transducer of claim 15 including a plurality of openings generally equally spaced between said magnet means and said pole elements.

18. The planar magnetic transducer of claim 15 wherein each of said opposing frame sections includes an outer surface which is formed to provide inwardly extending portions, said magnetic means being mounted to said inwardly extending portions.

19. The planar magnetic transducer of claim 15 wherein said magnet means are permanent magnets.

20. The planar magnetic transducer of claim 19 wherein said pole elements are generally U-shaped in cross-section.

* * * * *